US005293697A

United States Patent [19]

Kawakami

[11] Patent Number: 5,293,697

[45] Date of Patent: Mar. 15, 1994

[54] VACUUM DRYING APPARATUS

[75] Inventor: Osamu Kawakami, Amagasaki, Japan

[73] Assignees: Nikku Industry Co., Ltd., Itami; Senju Metal Industry Co., Ltd., Tokyo, both of Japan

[21] Appl. No.: 991,224

[22] Filed: Dec. 16, 1992

[30] Foreign Application Priority Data

Dec. 26, 1991 [JP] Japan ..... 3-107507[U]

[51] Int. Cl.[5] ..... F26B 13/30

[52] U.S. Cl. ..... 34/92; 34/109; 34/184

[58] Field of Search ..... 34/15, 92, 12, 13, 5, 34/184, 109

[56] References Cited

U.S. PATENT DOCUMENTS 4,180,918 1/1980 Ostrowski ..... 34/92 X 5,115,576 5/1992 Roberson, Jr. et al. ..... 34/92 X

FOREIGN PATENT DOCUMENTS 63-302521 12/1988 Japan .

1-235604 9/1989 Japan .

2-50071 2/1990 Japan .

*Primary Examiner*—Henry A. Bennet

*Attorney, Agent, or Firm*—Nikaido, Marmelstein, Murray & Oram

[57] ABSTRACT

This invention relates to a vacuum drying apparatus for continuously drying treated articles subjected to washing treatment with water such as electronic components. A plurality of vacuum tanks each incorporating therein heaters are disposed concyclically on a rotary table, and a carry-in apparatus for carrying in treated articles washed with water and a carry-out apparatus for carrying out dried treated articles are disposed in a carry-in/out zone of the treated articles. Furthermore, hot air heating devices for blowing hot air to the treated articles subjected to water washing treatment are disposed in the carry-in apparatus.

13 Claims, 3 Drawing Sheets

VACUUM DRYING APPARATUS

BACKGROUND OF THE INVENTION

This invention relates to a vacuum drying apparatus for efficiently drying high-tech components such as components for electronic devices and medical equipment after washing them with water.

Conventionally, high-tech components such as components for electronic devices and medical equipment have generally been washed with solvents such as fluorocarbon, 1.1.1-trichloroethane, or trichloroethylene.

According to the Wien Convention, Montreal Protocol signed in May, 1989, however, it was agreed to totally cancel the use of fluorocarbons by A.D. 2000. Accordingly, the use of the fluorocarbon solvents has been avoided as much as possible and washing with water, which is entirely pollution-free, has been made instead recently. However, washing with water involves the problem that the drying time is longer than washing with the solvents described above.

On the other hand, the high-tech components such as components for electronic devices and medical equipment are produced continuously by automated machine, and come off the line through a washing step generally at a rate of one component per one or two minutes and one component per about 30 seconds in a short case.

Therefore, the greatest future problem will be how efficiently the high-tech components washed with water, the treated articles, can be dried.

SUMMARY OF THE INVENTION

In view of the problems with the prior art described above, the present invention aims at providing a vacuum drying apparatus capable of efficiently drying treated articles such as components for electronic devices and medical equipment after they are washed with water.

The vacuum drying apparatus according to the present invention, capable of accomplishing the object described above, has the construction wherein a plurality of vacuum tanks each incorporating therein heaters are disposed concyclically on a rotary table, a carry-in apparatus for carrying in treated articles subjected to water washing treatment and a carry-out apparatus for carrying out dried treated articles are so disposed as to correspond to a vacuum tank disposed in a carry-in/out zone of the treated articles, and hot air jetting devices for blowing hot air on the treated articles, after water washing treatment, are disposed in the carry-in apparatus.

After water droplets adhering to the treated articles, which underwent a water washing treatment, are blown off by the hot air jetted from the hot air jetting devices, the treated articles are carried into the vacuum tanks and are vacuum dried. In this way, the treated articles washed with water can be dried efficiently.

Furthermore, since the present invention sequentially carries the treated articles washed with water into a plurality of vacuum tanks disposed on the rotary table rotating intermittently, the present invention can efficiently dry the treated articles, which are supplied intermittently with a time interval of dozens of seconds, without causing delay.

Since the carry-in/out apparatuses of the treated articles are disposed adjacent to one another in the present invention, the overall structure of the apparatus can be made compact.

DESCRIPTION OF THE PREFERRED EMBODIMENTS

Hereinafter, preferred embodiments of the present invention will be described with reference to the accompanying drawings.

Figure 1:
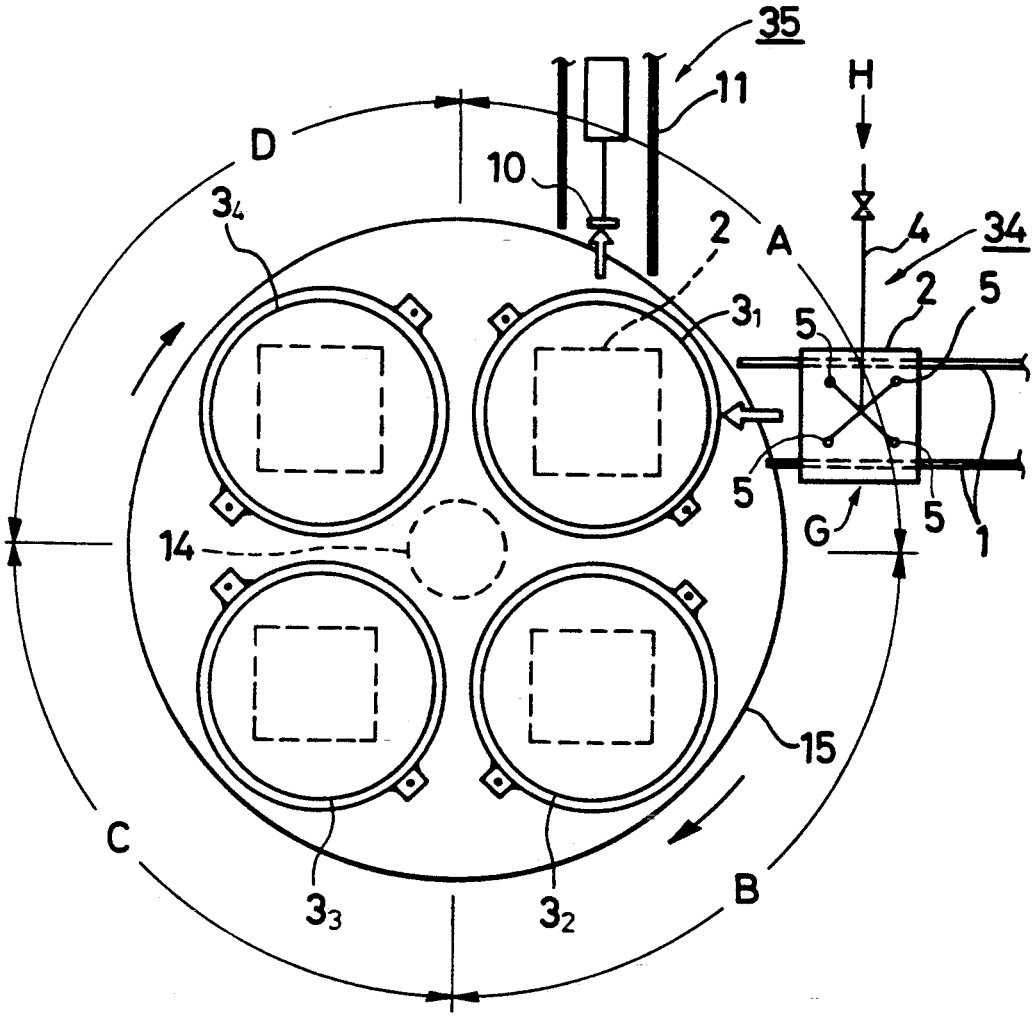
FIG. 1 is a plan view of a vacuum drying apparatus according to the present invention.
Figure 2:
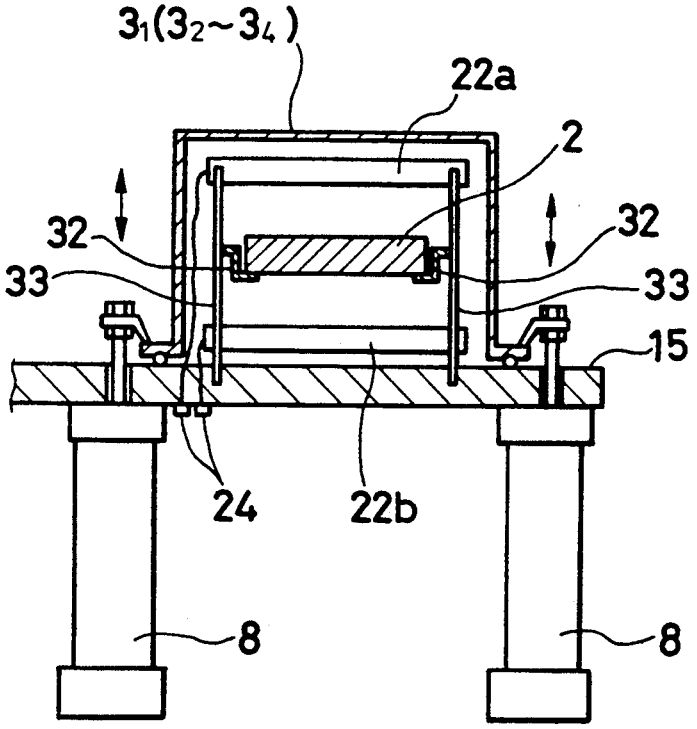
FIG. 2 is a longitudinal sectional view of a vacuum tank.
Figure 3:
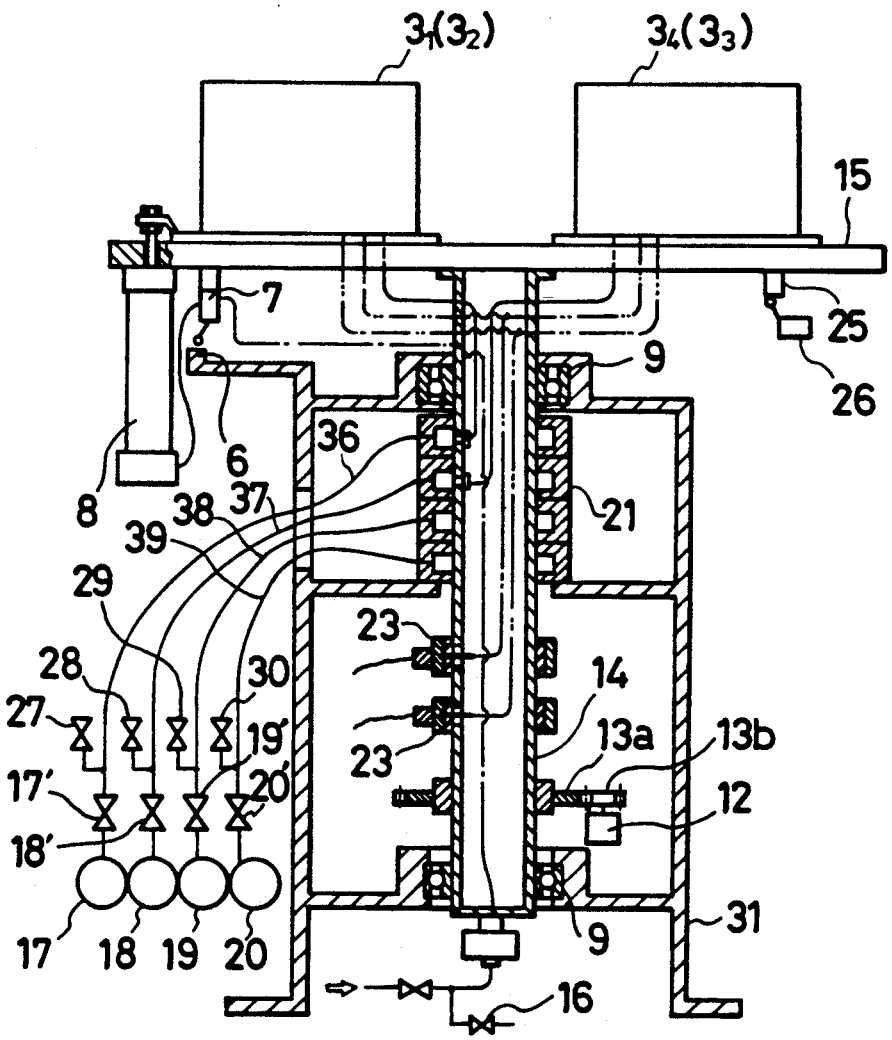
FIG. 3 is a side view containing a partial section of the vacuum drying apparatus according to the present invention.

In FIG. 1, reference numeral 15 denotes a rotary table, and a shaft 14 is fixed to the center of this rotary table 15. The shaft 14 is fitted rotatably to a table 31 through bearings 9, 9 as shown in FIG. 3. A small gear **13*b* fitted to a shaft of a motor 12 is meshed with a large gear 13*a* fitted to this rotary shaft 14, and the rotary table 15 is rotated intermittently by 90° and clockwise by controlling the revolution of the motor 12**.

On the other hand, four vacuum tanks $3_1$, $3_2$, $3_3$, $3_4$ are disposed concyclically and equidistantly on the rotary table 15 as shown in FIG. 1. A frame 32 for holding a treated article 2 such as an electronic component is disposed inside each of the vacuum tanks $3_1$ to $3_4$. Furthermore, heaters **22*a*, 22*b* are disposed above and below each frame 32 with predetermined gaps with the frame. The frame 32 and the heaters 22*a*, 22*b* are supported on the rotary table 15 by support members 33. Each of the vacuum tanks $3_1$ to $3_4$ is supported by a pair of air cylinders 8, 8. Each air cylinder 8 incorporates therein a spring. When compressed air is supplied into the cylinder, the cylinders lift up the respective vacuum tank $3_1$ to $3_4$ against the force of the spring, and when compressed air inside the cylinders is discharged, each vacuum tank $3_1$ to $3_4$ is hermetically pressed onto the rotary table 15** by the force of the spring.

The rotary table 15 is rotated clockwise by 90° and intermittently as described above. However, the zone ranging from 0:00 O'clock to 3:00 O'clock is a carry-in/out zone A of the treated article and three zones B, C and D between 3:00 to 6:00, 6:00 to 9:00 and 9:00 to 0:00 are drying zones, respectively.

A carry-in conveyor 1 and a carry-out apparatus 35 are disposed in the carry-in/out zone A in such a manner as to correspond to the vacuum tank existing inside this zone A such as the vacuum tank $3_1$. A hot air jetting device 34 for jetting hot air to the treated article 3 which is washed with water, is disposed above the carry-in conveyor 1. This hot air jetting device 34 consists of a pipe 4 having four-branched pipes provided at its leading end, each branched pipe having a nozzle 5 provided at its tip. The hot air jetting device 34 is disposed at a position where the treated article 2 carried into the vacuum tank is stopped by the carry-in conveyor 1 at a predetermined position G. The carry-out apparatus 35 consists of a take-out device 10 for taking out the treated article 2 on the frame 32 and a carry-out conveyor 11 for carrying out the treated article taken out by the take-out device 10.

Furthermore, an air limit switch 7 is so disposed on the lower surface of the rotary table 15 as to correspond to the vacuum tank $3_1$ as shown in FIG. 3. When this air limit switch 7 comes into contact with a constant position sensing dog 6 fixed to the table 31, compressed air is supplied into the air cylinders 8 from the compressed air source, not shown in the drawings. After the passage of a predetermined time, an exhaust valve 16 is opened, and compressed air inside the air cylinders 8 is exhausted. Air limit switches, not shown, are also so disposed as to correspond to the vacuum tanks $3_2$, $3_3$ and $3_4$ in the same way as the vacuum tank $3_1$, respectively.

Furthermore, the vacuum tank $3_1$ is connected to a vacuum pump 17 through a quadruple vacuum rotary joint 21 fitted to the shaft 14. A valve 17′ and a leak valve 27 are disposed at intermediate positions of a pipe 36 connecting the vacuum rotary joint 21 to the vacuum pump 17. The valve 17′ is opened when the vacuum tank $3_1$ reaches the vacuum drying zone B due to the rotation of the rotary table 15, and when the rotary table 15 further rotates, the vacuum tank $3_1$ then reaches the carry-in/out zone A and the dog 25 so fitted to the rotary table 15 as to correspond to the vacuum tank $3_1$ comes into the electric limit switch 26, the valve 17′ is closed. The opening/closing operation of the leak valve 27 is opposite to that of the valve 17′.

The vacuum tanks $3_2$, $3_3$, $3_4$ have the same function as that of the vacuum tank $3_1$, and are connected to the vacuum pumps 18, 19, 20 through quadruple rotary joints 21, respectively. Here reference numerals 18′, 19′ and 20′ denote the valves, reference numerals 28, 29 and 30 denote the leak valves, and reference numerals 37, 38 and 39 denote the pipes, respectively.

The heaters 22*a*, 22*b* inside the vacuum tanks $3_1$ to $3_4$ are connected to a power source, not shown, through rotary current collectors 23, 23. The heaters 22*a*, 22*b* are turned ON when they reach the vacuum drying zone B in the same way as the vacuum drying system and are turned OFF when they reach the carry-in/out zone A. Reference numeral 24 denotes a terminal.

Next, the operation of the apparatus described above will now be explained.

When the treated article 2 washed with water in the washing step stops at the constant position G, set on the carry-in conveyor 1 ahead of the rotary table 15, hot air H is jetted from a plurality of nozzles 5 of the hot drying apparatus 34 and water droplets adhering to the treated article 2 are blown off. At this time, the treated article 2 is preheated by hot air H jetted from the nozzles 5 described above.

While removal of the water droplets of the treated article 2 is being carried out on the carry-in conveyor 1, the rotary table 15 rotates clockwise by 90° and the vacuum tank $3_1$ reaches the carry-in/out zone A. When the air limit switch 7 of the vacuum tank $3_1$ comes into contact with the constant position sensing dog 6, compressed air is introduced into the air cylinder 8 and the vacuum tank $3_1$ is lifted up. Then, the vacuum-dried treated article 2 is taken out by the take-out device 10 to the carry-out conveyor 11.

When the withdrawing operation of the treated article 2 is completed, an undried treated article 2 on the carry-in conveyor 1 is taken into the frame 32 of the vacuum tank $3_1$. When the carry-in operation of the treated article 2 is completed and the exhaust valve 16 is opened, compressed air inside the air cylinder 8 is released and the vacuum tank $3_1$ is brought into close contact with the rotary table 15 by the spring inside the air cylinder 8.

Next, the motor 12 rotates and when the rotary table 15 rotates by 90° and the vacuum tank $3_1$ reaches the drying zone B, the valve 17′ is opened and air inside the vacuum tank $3_1$ is sucked by the vacuum pump 17. At the same time, power is supplied to the heaters 22*a*, 22*b* and the treated article 2 is vacuum dried under heating by the heaters 22*a*, 22*b*. At this time, the vacuum tank $3_4$ reaches the carry-in/out zone A and the carry-in/out operation of the dried treated article is carried out.

The dried treated article 2 transferred from the carry-in/out zone A to the drying zone B is continuously vacuum dried in the drying zones B to D.

As described above, since the rotary table 15 rotates intermittently, drying of the treated articles 2 is carried out continuously by a plurality of vacuum tanks $3_1$ to $3_4$ disposed on the rotary table 15.

What is claimed is:

1. A vacuum drying apparatus comprising
   a rotary table;
   two or more vacuum tanks, each of said vacuum tanks being capable of receiving an article to be dried, said vacuum tanks being concyclically disposed on said rotary table so as to define multiple zones, one of said zones being a carry-in and carry-out zone; and
   a heater in each of said vacuum tanks means to produce a vacuum in said vacuum tanks.

2. A vacuum drying apparatus according to claim 1, further comprising
   a hot air jetting device in said carry-in zone.

3. A vacuum drying apparatus according to claim 1, further comprising
   a frame located within said vacuum tank.

4. A vacuum drying apparatus according to claim 3, further comprising a rotary current collector for connecting said heater to a power supply.

5. A vacuum drying apparatus according to claim 1, further comprising
   a lifting means associated with each of said vacuum tanks for selectively lifting said vacuum tank off of said rotary table.

6. A vacuum drying apparatus according to claim 5, wherein each said lifting means comprises
   at least one air cylinder with engaged and disengaged modes wherein when said air cylinder is in an engaged mode the vacuum tank is lifted off of said rotary table; and
   a spring for hermetically sealing said vacuum tank to said rotary table when said at least one air cylinder is in said disengaged mode.

7. A vacuum drying apparatus according to claim 1, further comprising
   a vacuum rotary joint for attaching said two or more vacuum tank to said means for producing a vacuum.

8. A vacuum drying apparatus according to claim 1, further comprising
   a carry-in apparatus; and
   a carry-out apparatus, said carry-in apparatus and said carry-out apparatus being disposed adjacent said carry-in and carry-out zone.

9. A vacuum drying apparatus according to claim 1, wherein said rotary table is rotated intermittently.

10. A vacuum drying apparatus according to claim 2, wherein said hot air jetting device comprises a pipe with a leading end having two or more branched pipes with tips on the ends thereof at said leading end, each of said branched pipes having a fluid jet nozzle fitted to said tip.

11. A vacuum drying apparatus according to claim 8, wherein said carry-out apparatus consists of a treated article take-out device and a carry-out conveyor.

12. A vacuum drying apparatus according to claim 8, wherein said carry-in apparatus comprises a carry-in conveyor.

13. A vacuum drying apparatus consisting of a rotary table;

four vacuum tanks concyclically disposed on said rotary table so as to define first, second, third and fourth zones;

wherein said rotary table is intermittently rotated so as to move said vacuum tank disposed in said first zone to said second zone, said vacuum tank disposed in said second zone to said third zone, said vacuum tank disposed in said third zone to said fourth zone, said vacuum tank disposed in said fourth zone to said first zone;

a frame located within each of said vacuum tanks;

a heater located within each of said vacuum tanks;

a rotary current collector for connecting said heater to a power supply;

two air cylinders attached to each of said vacuum tanks with engaged and disengaged modes wherein when said air cylinders are in the engaged mode said vacuum tank is lifted off of said rotary table;

a spring attached to each of said vacuum tanks for hermetically sealing said vacuum tank to said rotary table when said air cylinders are in said disengaged mode;

a vacuum rotary joint for attaching each of said vacuum tanks to a vacuum pump;

a switching device so as to engage said air cylinders when said cylinders are in said first zone and to disengage said air cylinders when said air cylinders are in said second, third and fourth zones;

a carry-in apparatus disposed so as to be capable of placing an article to be treated in said vacuum tank in said first zone;

a carry-out apparatus disposed so as to be capable of removing a treated article from said vacuum tank in said first zone; and a hot air jetting device disposed in said carry-in apparatus, wherein said jetting device comprises a pipe with a leading end having two or more branched pipes with tip ends at said leading end, each of said branched pipes having fluid jet nozzle fitted to said tip.

* * * * *